US011513475B2

(12) United States Patent
Ruefenacht

(10) Patent No.: US 11,513,475 B2
(45) Date of Patent: Nov. 29, 2022

(54) TIMEPIECE COMPRISING AM-PM INDICATING MEANS

(71) Applicant: ETA SA Manufacture Horlogere Suisse, Grenchen (CH)

(72) Inventor: Christian Ruefenacht, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 314 days.

(21) Appl. No.: 16/998,035

(22) Filed: Aug. 20, 2020

(65) Prior Publication Data

US 2021/0103251 A1 Apr. 8, 2021

(30) Foreign Application Priority Data

Oct. 4, 2019 (EP) ..... 19201390

(51) Int. Cl.
*G04B 19/04* (2006.01)
*G04B 19/25* (2006.01)

(52) U.S. Cl.
CPC ..... *G04B 19/25* (2013.01); *G04B 19/04* (2013.01)

(58) Field of Classification Search
CPC ..... G04B 19/04; G04B 19/25; G04B 19/046; G04B 19/048
See application file for complete search history.

(56) References Cited

U.S. PATENT DOCUMENTS 4,059,953 A * 11/1977 Morrison ..... G04B 19/25366 368/36
4,222,227 A * 9/1980 Arabian ..... G04B 19/223 968/167
4,740,934 A * 4/1988 Noirjean ..... G04B 19/163 368/233
5,327,401 A 7/1994 Besson et al.
5,469,410 A 11/1995 Berney
6,842,404 B2 * 1/2005 Haselberger ..... G04B 19/202 368/77
7,075,860 B2 * 7/2006 Dias ..... G04B 19/202 368/221

(Continued)

FOREIGN PATENT DOCUMENTS

CH 343 915 A 12/1959
CH 502 629 A 9/1970

(Continued)

OTHER PUBLICATIONS

European Search Report dated Apr. 1, 2020 in European Application 19201390.2 filed Oct. 4, 2019 (with English Translation of Categories of Cited Documents), 3 pages.

(Continued)

*Primary Examiner* — Sean Kayes
(74) *Attorney, Agent, or Firm* — Oblon, McClelland, Maier & Neustadt, L.L.P.

(57) ABSTRACT

A timepiece including at least analogue time display device, and an AM-PM display device for displaying day-night information in the dial of the timepiece. The AM-PM display device includes at least two apertures made in the dial of the watch, a rotating display disc bearing at least one first series of inscriptions corresponding to the day and at least one second series of inscriptions corresponding to the night, these two display series being disposed on at least two concentric circles, and a drive mechanism arranged so as to automatically and alternately bring the first series of inscriptions inside a first aperture and the second series of inscriptions inside a second aperture by rotating the display disc.

8 Claims, 6 Drawing Sheets

(56) References Cited

U.S. PATENT DOCUMENTS

| | | | | |
|---|---|---|---|---|
| 8,801,269 | B2 * | 8/2014 | Grossenbacher | G04B 19/225 368/208 |
| 8,913,467 | B2 * | 12/2014 | Claret | G04B 47/04 273/293 |
| 9,459,590 | B1 * | 10/2016 | Lecher | G04C 17/0091 |
| 9,612,577 | B2 * | 4/2017 | Lecher | G04C 17/0058 |
| 9,880,520 | B2 * | 1/2018 | Lecher | G04C 17/0091 |
| 10,078,309 | B2 * | 9/2018 | Capt | G04B 19/268 |
| 11,137,722 | B2 * | 10/2021 | Mitamura | G04B 19/202 |

FOREIGN PATENT DOCUMENTS

| | | | |
|---|---|---|---|
| CH | 712 267 | A1 | 9/2017 |
| CN | 2275726 | Y | 3/1998 |
| CN | 2416518 | Y | 1/2001 |
| CN | 1733343 | A | 2/2006 |
| CN | 101676820 | A | 3/2010 |
| CN | 101872153 | A | 10/2010 |
| CN | 102645885 | A | 8/2012 |
| CN | 103064278 | A | 4/2013 |
| CN | 104730898 | A | 6/2015 |
| CN | 106066594 | A | 11/2016 |

OTHER PUBLICATIONS

Combined Chinese Office Action and Search Report dated Aug. 13, 2021 in Chinese Patent Application No. 202010967779.X (with English translation), 8 pages.

* cited by examiner

TIMEPIECE COMPRISING AM-PM INDICATING MEANS

CROSS-REFERENCE TO RELATED APPLICATION

This application claims priority to European Patent Application No. 19201390.2 filed on Oct. 4, 2019, the entire disclosure of which is hereby incorporated herein by reference.

FIELD OF THE INVENTION

The invention relates to the field of horology, and in particular to the field of watches. The invention more particularly relates to a timepiece provided with an AM-PM display device making the AM-PM indication appear in two apertures made in the dial of the watch, and a rotating disc bearing at least a first series of inscriptions corresponding to the morning and at least a second series of inscriptions corresponding to the afternoon, these two display series being disposed on at least two concentric circles.

BACKGROUND OF THE INVENTION

The prior art comprises numerous documents regarding AM/PM display devices.

Displaying the moment in the day by means of a disc having a visible surface that is driven so as to undergo one revolution every twenty-four hours in the same direction as the hour hand is known. The visible surface of the disc visually defines two half-discs for indicating the AM-PM information regarding the hour displayed by this hour hand.

However, such a display does not allow the AM-PM information to be read in a simple and direct manner, since this type of display is generally small in size. Similarly, when setting the time, it is not easy to quickly check whether it is set to the morning or afternoon.

SUMMARY OF THE INVENTION

The purpose of the invention is in particular to overcome the different drawbacks of these known techniques.

More specifically, one purpose of the invention is to provide a watch with an AM-PM display that is easy to adjust, has a simple design and is inexpensive to implement These purposes, and others that will appear more clearly hereafter, are achieved according to the invention by way of a timepiece comprising at least analogue time display means, and an AM-PM display device for displaying day-night information in the dial of said timepiece.

According to the invention, the AM-PM display device comprises at least two apertures made in the dial of the watch, a rotating display disc bearing at least one first series of inscriptions corresponding to the day and at least one second series of inscriptions corresponding to the night, these two display series being disposed on at least two concentric circles, and a drive mechanism arranged so as to automatically and alternately bring said first series of inscriptions inside a first aperture and said second series of inscriptions inside a second aperture by rotating said display disc.

Thus, the subject matter of the present invention, through the different functional and structural aspects thereof described hereinabove, procures a watch with an AM-PM display that has a simple design, low overall dimensions and that can be adapted to numerous existing models.

According to other advantageous alternative embodiments of the invention:

- said display disc is off-centred relative to the time display means;
- said display disc pivots about the time display means;
- the first and second apertures are diametrically opposite one another relative to the time display means;
- the AM/PM inscriptions of the first and second series of inscriptions are disposed along the same radius of the display disc;
- the first and second series of inscriptions each comprise seven inscriptions, disposed every 360°/7;
- said drive means comprise an hour wheel and a fourteen-tooth star-wheel integral with said display disc, said star-wheel being arranged so as to cooperate with two diametrically opposite fingers integral with the hour wheel;
- said display disc comprises a third series of inscriptions indicating the name of the day of the week displayed in a third aperture formed in the dial.

BRIEF DESCRIPTION OF THE DRAWINGS

Other features and advantages of the invention will be better understood upon reading the following description given of a non-limiting specific embodiment of the invention, provided for illustration purposes with reference to the accompanying figures, in which.

DETAILED DESCRIPTION OF THE PREFERRED EMBODIMENTS

A timepiece comprising at least analogue time display means, and an AM-PM display device for displaying day-night information in the dial of said timepiece according to the invention will be described hereinbelow with joint reference to FIGS. 1 to 5.

Figure 1:
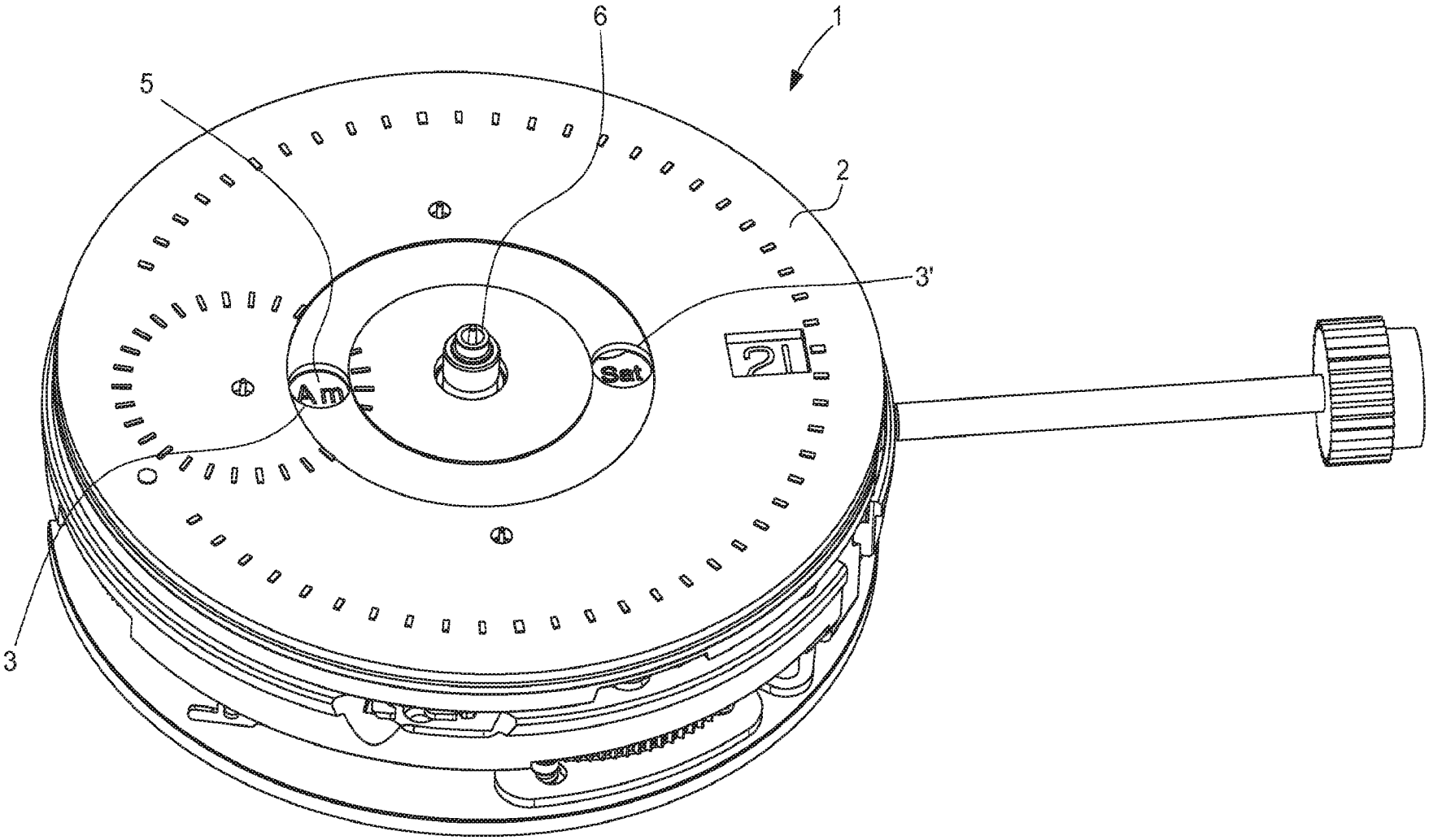
FIG. 1 is a perspective view of a horological movement comprising a display device according to the invention.
Figure 2A:
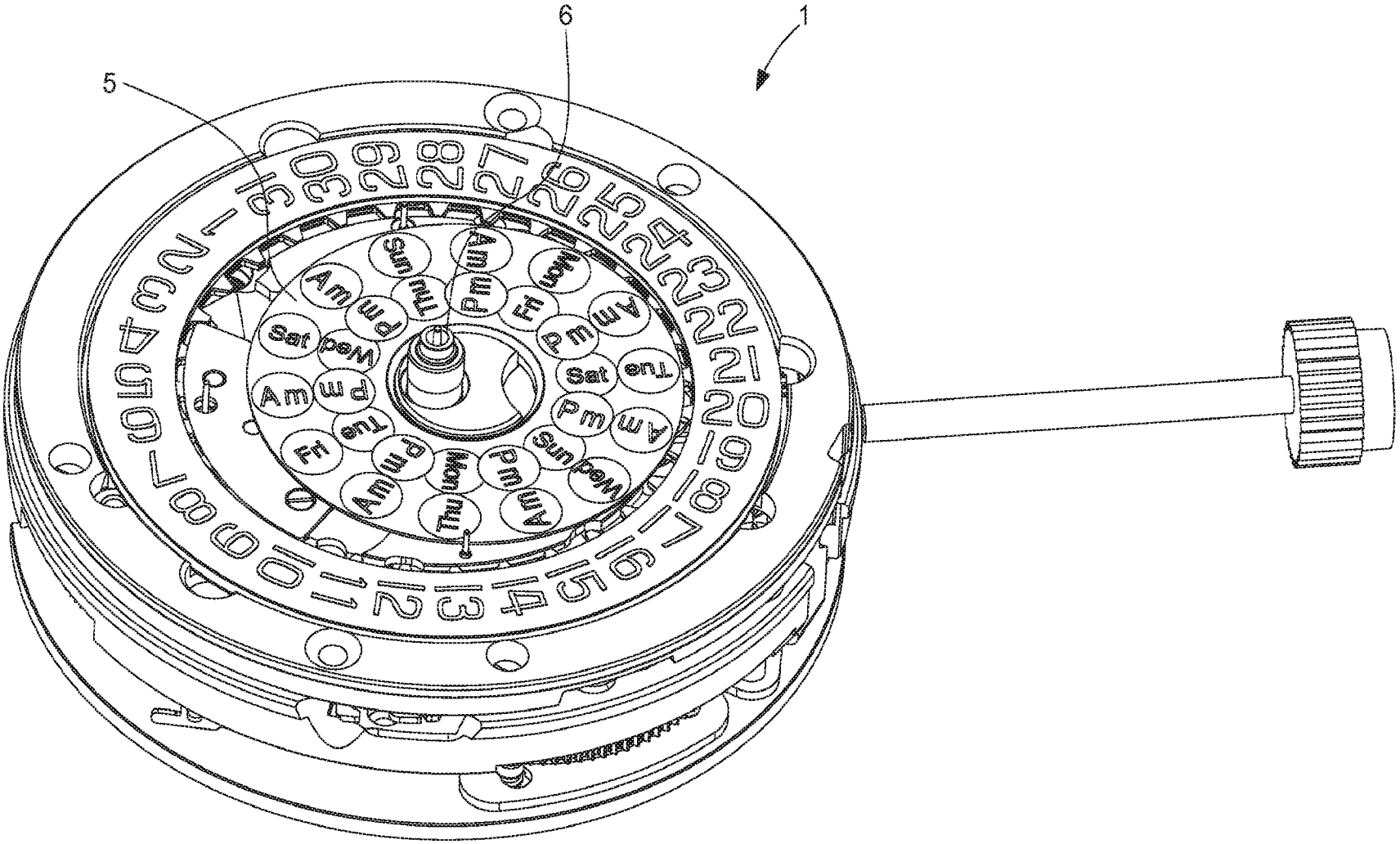
FIGS. 2*a* and 2*b* respectively show views of the display device according to a first and second embodiment of the invention.
Figure 2B:
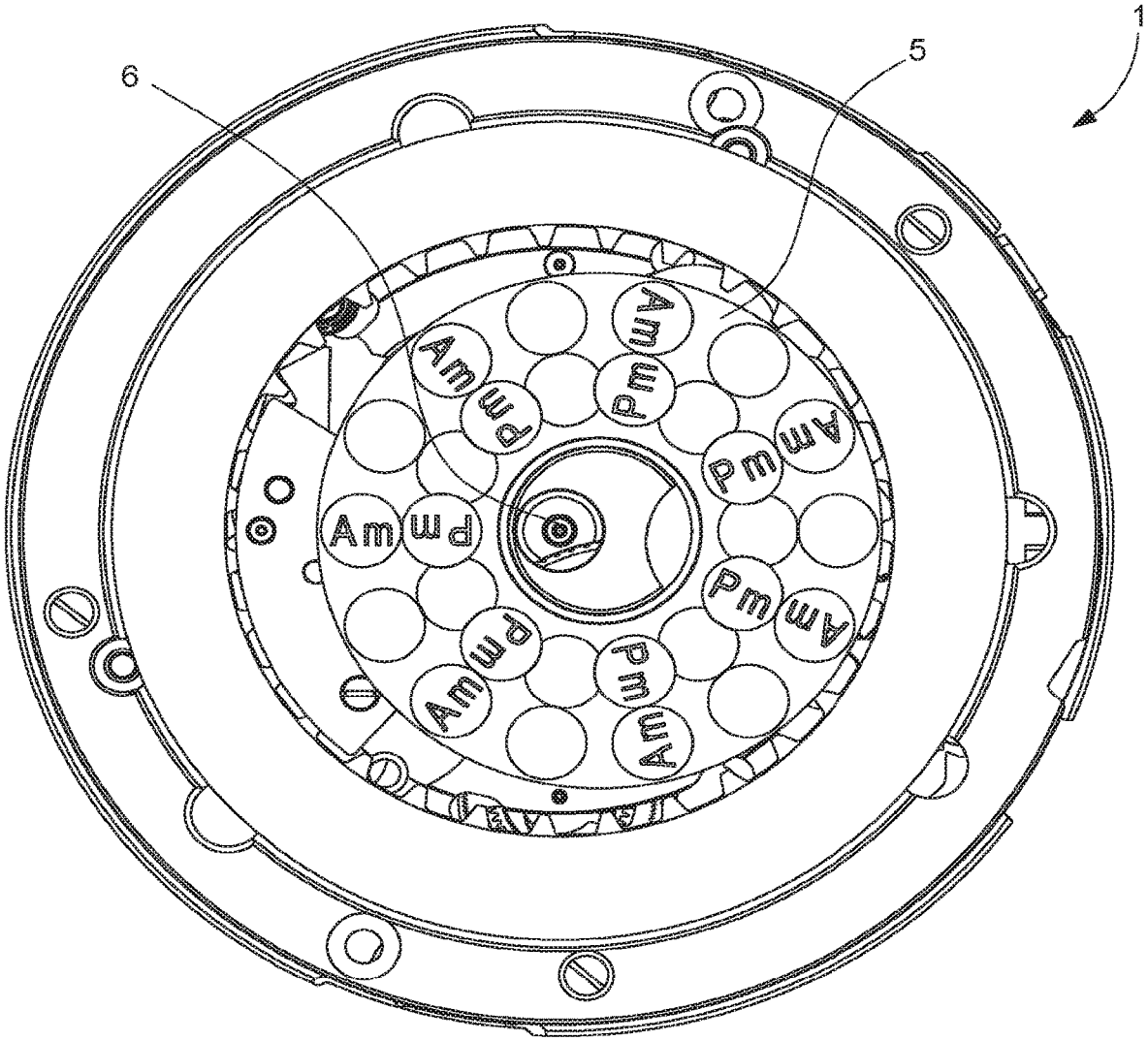
Figure 3:
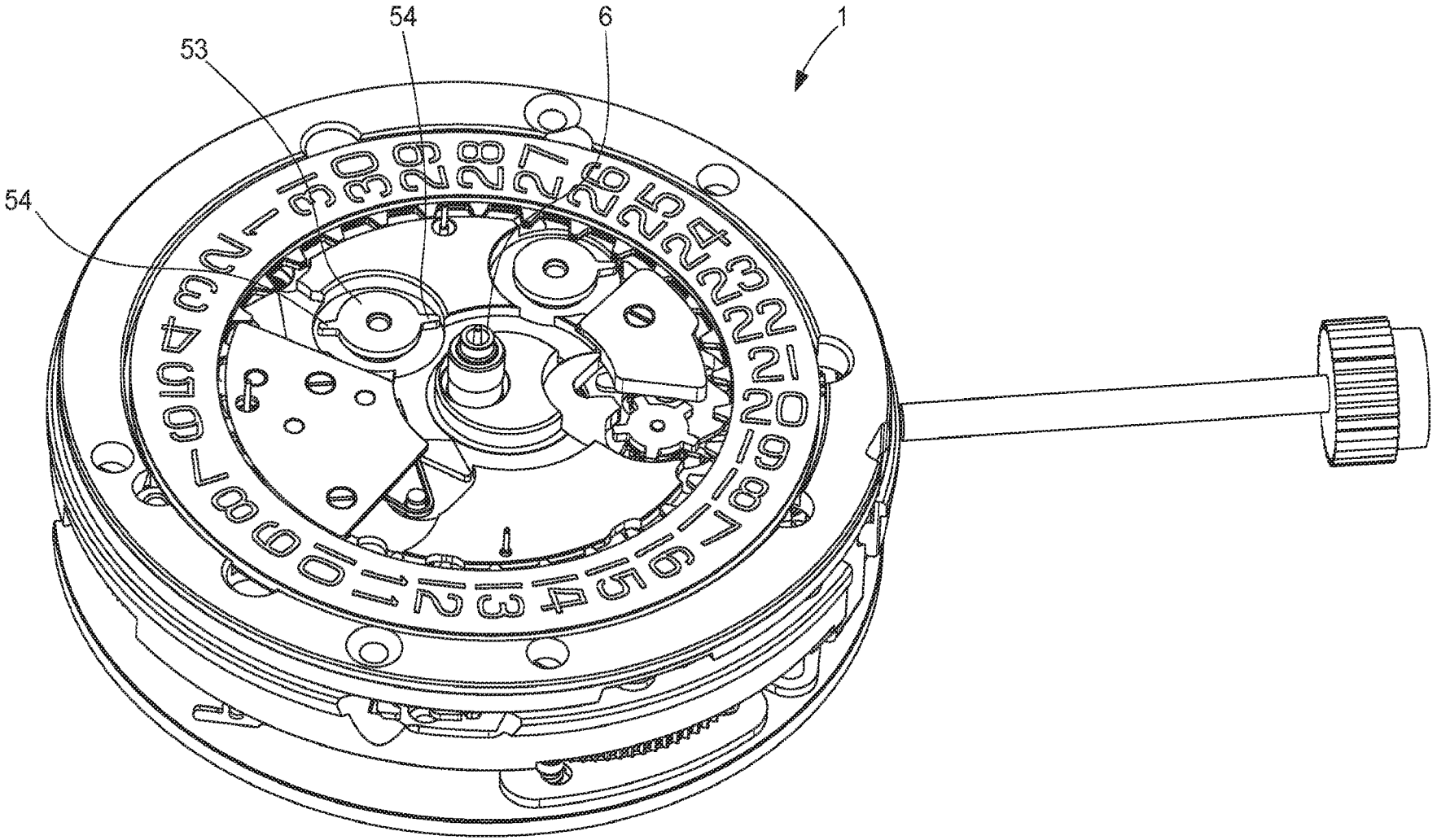
FIG. 3 shows a detailed view of a device according to the invention without the display disc.
Figure 4A:
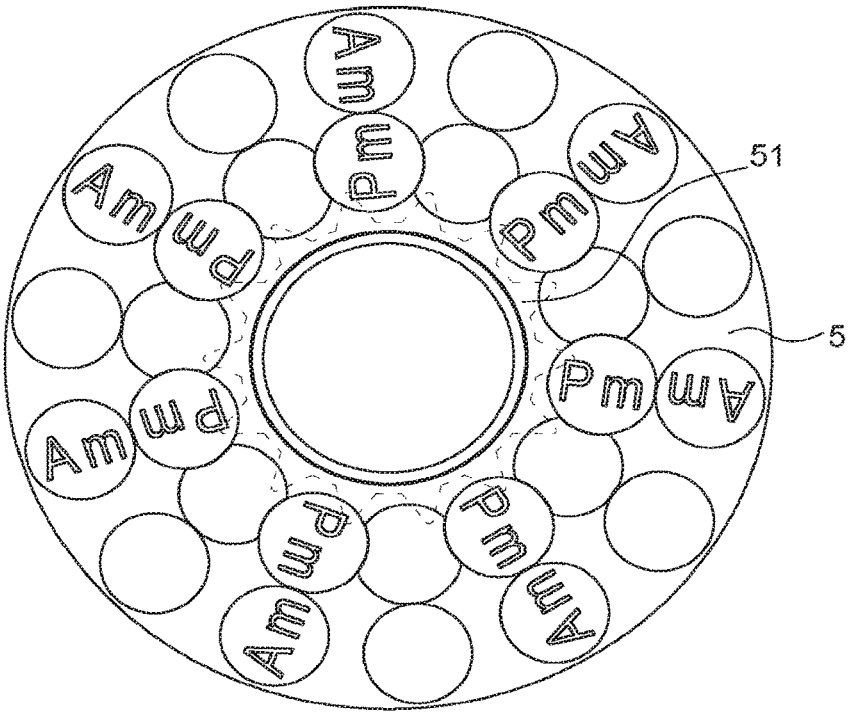
FIGS. 4*a* to 4*c* are overhead, bottom and profile views of the display disc of the device according to the invention.
Figure 4B:
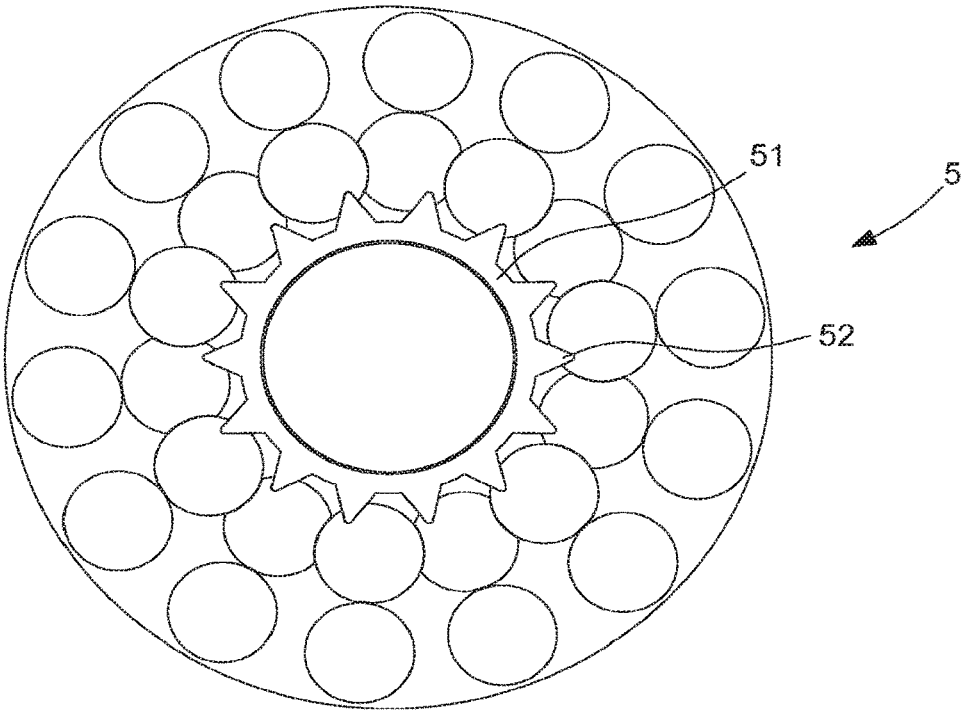
Figure 4C:
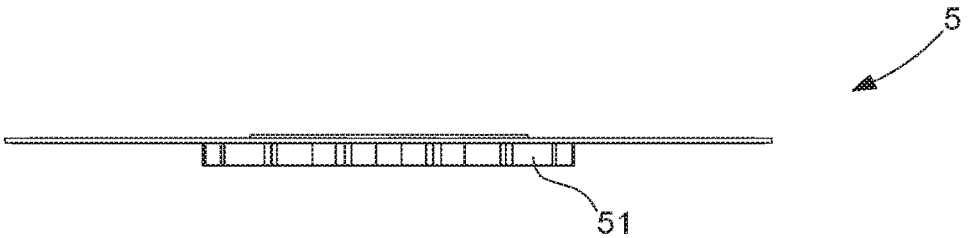

With reference to FIGS. 1 and 2, the dial 2 of a watch 1 is represented by a disc and includes at least two apertures 3, 3' in which respectively appear an inscription indicating AM or PM, the two apertures 3, 3' being diametrically opposite one another relative to the time display means 6 formed in a conventional manner by hands. These inscriptions are inscribed on a rotating disc or ring referred to as a display disc 5, disposed beneath the dial 2, and which bears a first series of AM inscriptions and a second series of PM inscriptions. In the embodiment shown in FIGS. 1 and 2, these two series of inscriptions are disposed on two concentric circles, the inscriptions being, in this case, disposed side by side. The first series of inscriptions is broken down into seven AM inscriptions and seven PM inscriptions and occupies the inner circle, the two display series being disposed on at least two concentric circles.

The display device further comprises a drive mechanism arranged so as to automatically and alternately bring said first series of inscriptions inside a first aperture and said second series of inscriptions inside a second aperture by rotating said display disc.

As can be seen, the inscriptions of each circle are disposed on radii of the display disc 5, the radii being spaced apart by 360°/7. Thanks to this disposition, one of the two inscriptions is alternately displayed in one of the two apertures 3, 3', the passage from the AM display to the PM display corresponding to a rotation of the display disc 5 by one seventh of a revolution, i.e. every twelve hours.

This disposition of the AM-PM inscriptions is particularly advantageous compared to a conventional disposition, whereby the inscriptions follow one another on the same circle, as this allows the size of the inscriptions to be significantly increased, while limiting the overall dimensions on the display disc and thus facilitates reading.

Figure 5:
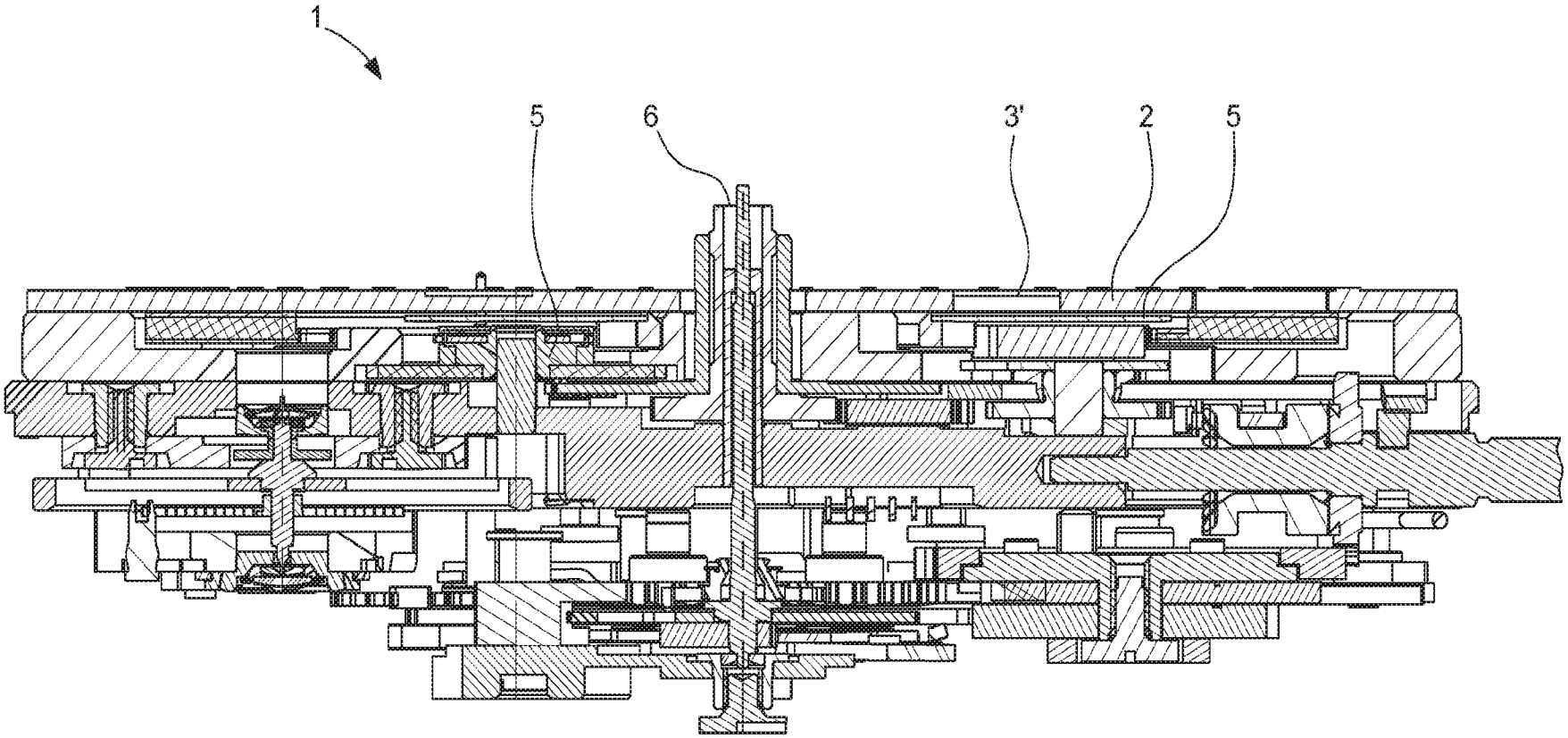
FIG. 5 is a sectional view of a horological movement comprising a display device according to the invention.

The watch, the movement whereof is partially viewed via a cross-section in FIG. 5, includes the dial 2 with an aperture 3 and the display disc 5.

The mechanism for driving this display disc is formed by a star-wheel 51 including a peripheral toothing 52 formed by fourteen teeth and which is arranged so as to cooperate with a wheel 53 bearing diametrically opposite fingers 54, the wheel 53 being driven by the hour wheel. The star-wheel 51 is integral with the display disc and centred thereabout, the two parts forming a one-piece element.

According to another embodiment of the invention shown in FIGS. 1 and 2*a*, the display disc 5 comprises additional inscriptions so as to also display the day of the week in one of the apertures 3, 3'.

Thanks to these different aspects of the invention, an AM/PM display device is procured that makes the watch simple to read and easy to adjust after an extended period during which the watch has not been worn. The invention further facilitates assembly/disassembly operations as well as maintenance for a timepiece equipped with a device according to the invention.

The above description corresponds to a preferred embodiment and can under no circumstances be considered to be limiting, and more particularly as regards the form described for the different structural elements composing the assembly device or the materials thereof.

The invention claimed is:

1. A timepiece comprising at least analogue time display means, and an AM-PM display device for displaying day-night information in the dial of said timepiece, the AM-PM display device comprising at least two apertures made in the dial of the watch, a rotating display disc bearing at least one first series of inscriptions corresponding to the day and at least one second series of inscriptions corresponding to the night, these two display series being disposed on at least two concentric circles, and a drive mechanism arranged so as to automatically and alternately bring said first series of inscriptions inside a first aperture and said second series of inscriptions inside a second aperture by rotating said display disc.

2. The timepiece according to claim 1, wherein said display disc is off-centred relative to the time display means.

3. The timepiece according to claim 1, wherein said display disc pivots about the time display means.

4. The timepiece according to claim 1, wherein the first and second apertures are diametrically opposite one another relative to the time display means.

5. The timepiece according to claim 1, wherein the AM/PM inscriptions of the first and second series of inscriptions are disposed along the same radius of the display disc.

6. The timepiece according to claim 1, wherein the first and second series of inscriptions each comprise seven inscriptions, disposed every 360°/7.

7. The timepiece according to claim 1, wherein said drive means comprise an hour wheel, a wheel with two fingers, and a fourteen-tooth star-wheel integral with said display disc, said star-wheel being arranged so as to cooperate with two diametrically opposite fingers integral with the hour wheel.

8. The timepiece according to claim 1, wherein said display disc comprises a third series of inscriptions indicating the name of the day of the week displayed in a third aperture formed in the dial.

* * * * *